US008661603B2

(12) United States Patent
Velazquez Arvizu

(10) Patent No.: US 8,661,603 B2
(45) Date of Patent: Mar. 4, 2014

(54) ACCESSORIES FOR SUPPLYING LIQUIDS TO APPLICATORS SUCH AS ROLLERS AND BRUSHES

(76) Inventor: Alberto Velazquez Arvizu, Guadalajara (MX)

( * ) Notice: Subject to any disclaimer, the term of this patent is extended or adjusted under 35 U.S.C. 154(b) by 73 days.

(21) Appl. No.: 13/322,100

(22) PCT Filed: May 25, 2010

(86) PCT No.: PCT/MX2010/000047
§ 371 (c)(1),
(2), (4) Date: Feb. 12, 2012

(87) PCT Pub. No.: WO2010/137936
PCT Pub. Date: Dec. 2, 2010

(65) Prior Publication Data

US 2012/0137463 A1 Jun. 7, 2012

(30) Foreign Application Priority Data

May 25, 2009 (MX) ..... MX/a/2009/005500

(51) Int. Cl.
*B44D 3/12* (2006.01)
*B05C 21/00* (2006.01)

(52) U.S. Cl.
USPC ..... 15/257.05; 15/257.06

(58) Field of Classification Search
USPC ..... 15/257.05, 257.06
See application file for complete search history.

(56) References Cited

U.S. PATENT DOCUMENTS

| | | | | |
|---|---|---|---|---|
| 2,533,355 | A | 12/1950 | Comfort | |
| 2,723,410 | A * | 11/1955 | Sprung et al. | 15/257.06 |
| 4,865,282 | A | 9/1989 | Yonkman et al. | |
| 5,207,348 | A | 5/1993 | Fischer et al. | |
| 6,041,919 | A | 3/2000 | Adams | |
| 7,137,168 | B2 * | 11/2006 | Mann | 15/257.06 |

FOREIGN PATENT DOCUMENTS

| | | |
|---|---|---|
| EP | 1723872 | 11/2006 |
| ES | 2243102 | 11/2005 |

OTHER PUBLICATIONS

International Search Report dated Nov. 16, 2010 for related PCT Application No. PCT/MX2010/000047.

* cited by examiner

*Primary Examiner* — Randall Chin
(74) *Attorney, Agent, or Firm* — Ryan A. Schneider, Esq.; Troutman Sanders LLP

(57) ABSTRACT

An accessory for supplying liquids to an applicator such as a roller or brush formed by a container and a dispensing device. The upper part of the container is provided with a cover including an opening dimensioned to match the head of the dispensing device, while the periphery of the opening is provided with notches for holding the neck of the roller. The dispensing device is formed by an upper head or cover, a perforated panel perpendicular to the latter, and a second panel including a screen and positioned at the end opposite the cover. The cover is flat and is provided along the periphery thereof with a material that fits hermetically to the opening. The cover is rectangular and the central part thereof widens out into two opposing semicircles, said cover also including a handle.

20 Claims, 10 Drawing Sheets

ACCESSORIES FOR SUPPLYING LIQUIDS TO APPLICATORS SUCH AS ROLLERS AND BRUSHES

CROSS-REFERENCE TO RELATED APPLICATIONS

This application is a U.S. National Stage of International Application No. PCT/MX2010/000047, filed 25 May 2010, which claims the benefit of MX/a/2009/005500, filed 25 May 2009, each herein fully incorporated by reference.

FIELD OF THE INVENTION

The present invention has a technical field in the mechanical area. Mechanics is applicable mainly due to the means used in systems to store, mix and dispense liquids such as paint, solvents and others which are volatile because of their nature.

OBJECT OF THE INVENTION

Generating a device for dispensing liquids (paint, solvents, and others of volatile nature) on different devices for applying paint, such as rollers, paintbrushes, brushes, palettes, mainly to enable us to save liquid consumption and when required, application time thereof, that is, by optimizing the use of the liquid through this invention.

BACKGROUND OF INVENTION

Technologies such as U.S. Pat. Nos. 555,858 2007, 4,128, 170 1978, 6,907,640, 2005, U.S. D518263 2006, U.S. D348755 1994, U.S. D361183 1995, U.S. Pat. No. 133,299 1942, UK2102369 2008, AU126795 1995, AU311985 2008, CA2566211 2004, DE102005039775 2006, U.S. D307110 1990, U.S. D303857 1989, WO2004030937, US2005235449, U.S. Pat. Nos. 4,205,411, 212,831, U.S. Ser. No. 10/643,626, U.S. Pat. Nos. 0,204,423, 6,622,340, 6,493, 901, D444604, U.S. Pat. No. 5,645,164, WO9801358, U.S. Pat. No. 6,622,884, US2005252920, WO2006069265, U.S. Pat. Nos. 6,394,152, 5,735,399, US2002005409, EP1920947, U.S. Ser. No. 10/065,990 are available within the state of the art.

Above mentioned patents describe different apparatuses or devices used to apply paint, i.e., containers and paint application devices which work similarly, being grouped below to be briefly explained.

Containers, having a main function of storing different amounts of paint with a shape allowing to take paint with the same device, this being run off when using it vertically or inclined in a separate accessory, while others allow the user to close the container, keeping paint from drying as it prevents the entry of air, there are also containers with a grid shape that is put vertically inside the paint container and this allows different devices for applying paint such as paintbrushes and rollers to be loaded, and there are other special devices with flat shapes especially for painting the surface edges with a roller system which prevents having to dip in order to soak the device.

Devices for applying paint: Edge device mentioned in the end part of the previous paragraph.

The main disadvantages of above mentioned patents is that the container is always fully open and in some cases the container presentation package has to be emptied, and although some packages referred to also have their own container, others require to empty the paint to a different container, but in all these cases the applicator must be dipped into the paint to drain the excesses in the container or accessory itself being always arranged in the top part thereof.

Above inventions result impractical, since they are devices for applying paint and containers providing particular specific solutions; technology aims to address all the problems involved in working with applying paint, such as:

- Having a practical container which in addition to storing paint, and allowing a simple and practical way of opening and closing, maintains the same properties of the material being used in the container because of the cover and dispensing device.
- Avoiding at most the ammonia and solvent smell in the case of oil-based paint.
- Dispensing the paint by using any device which allows avoiding runoff permitting painting edges without using means such as adhesive tapes, guides, templates, etc.
- Shaking and stifling the paint, leaving it smooth for application.
- Allowing the device container to be arranged at high altitudes and handling the same applicator from floor without causing displacement of the subject who uses it, neither an excessive handling of levers to use the container and device for applying paint remotely.
- Allowing the paint devices not to dry the paint, since when covering them air is kept from entry and consequently it is not necessary to wash them constantly.
- The cover has a mold for attaching the device neck for applying paint and not being inserted into the container.

DESCRIPTION OF THE INVENTION

Figure 1:
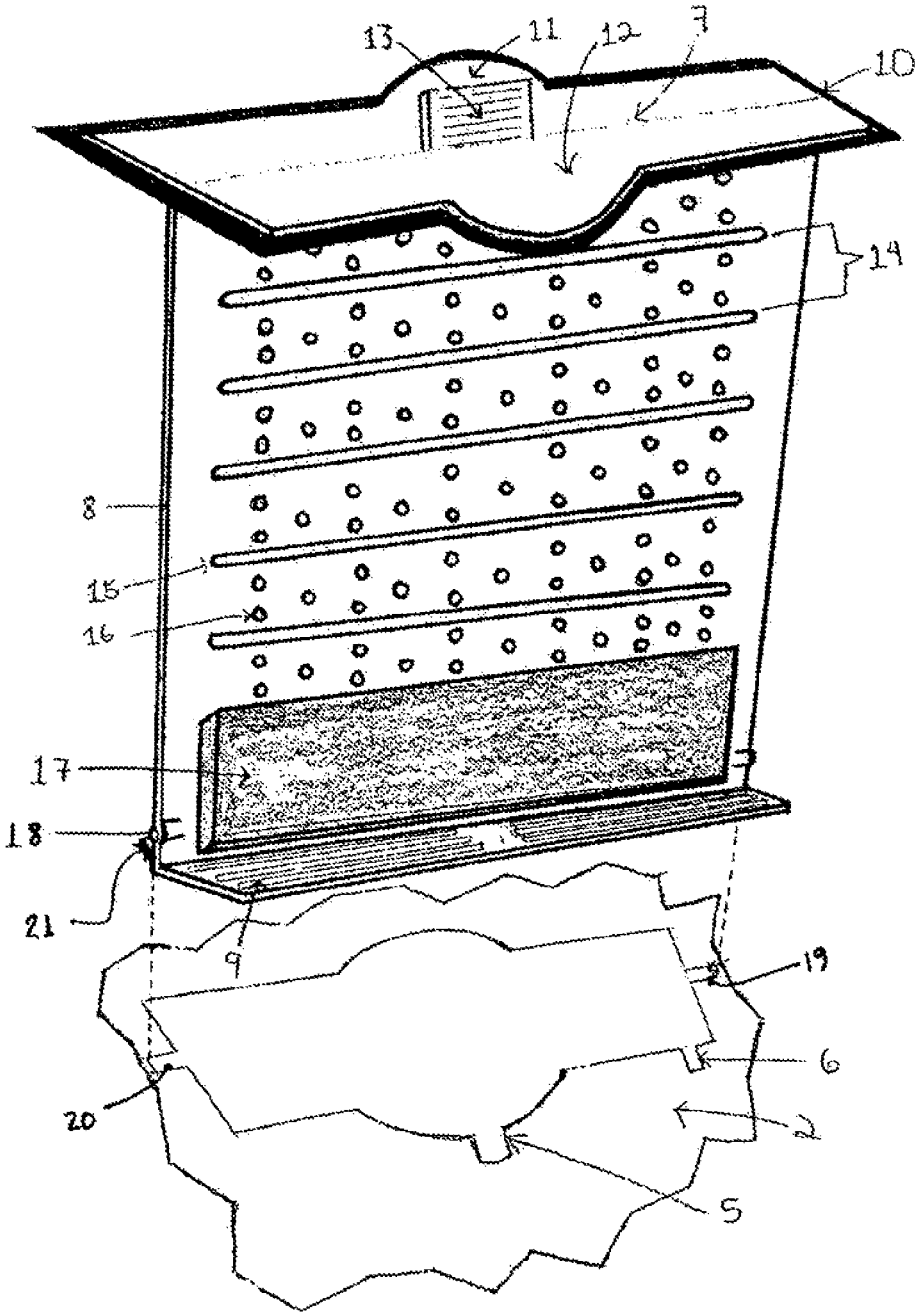
FIG. 1 is a perspective view of the accessory for supplying fluids to an applicator roller and brush with a container cross-section.
Figure 2:
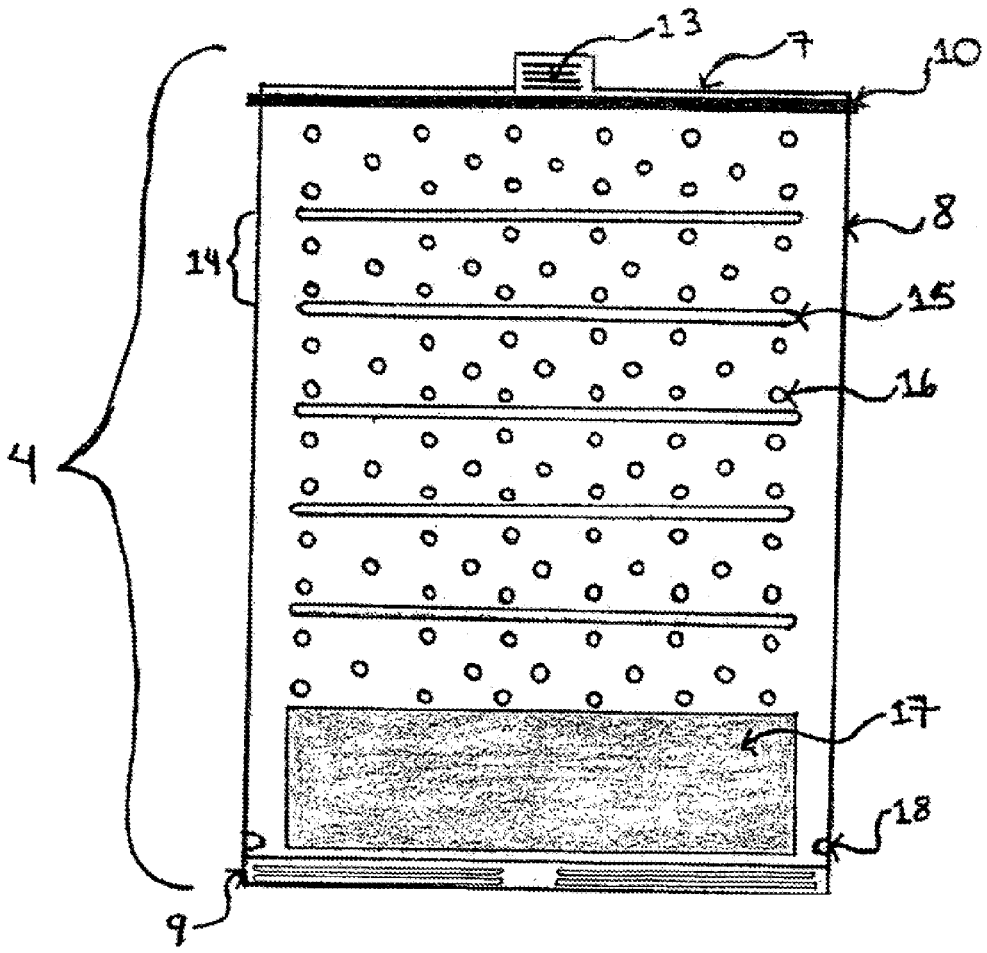
FIG. 2 is a front view of the accessory for supplying fluids to an applicator roller and brush.

To facilitate an understanding of the principles and features of the various embodiments of the invention, various illustrative embodiments are explained below. Although exemplary embodiments of the invention are explained in detail, it is to be understood that other embodiments are contemplated. Accordingly, it is not intended that the invention is limited in its scope to the details of construction and arrangement of components set forth in the following description or illustrated in the drawings. The invention is capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named.

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" one particular value and/or to "about" or "approximately" another particular value. When such a range is expressed, other exemplary embodiments include from the one particular value and/or to the other particular value.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described as making up the various elements of the invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

The characteristic details of this new liquid storage, stifling and dispensing system are clearly shown in the following description and accompanying drawings, as well as an illustration and using the same reference signs to indicate the parts and figures shown.

Figure 3:
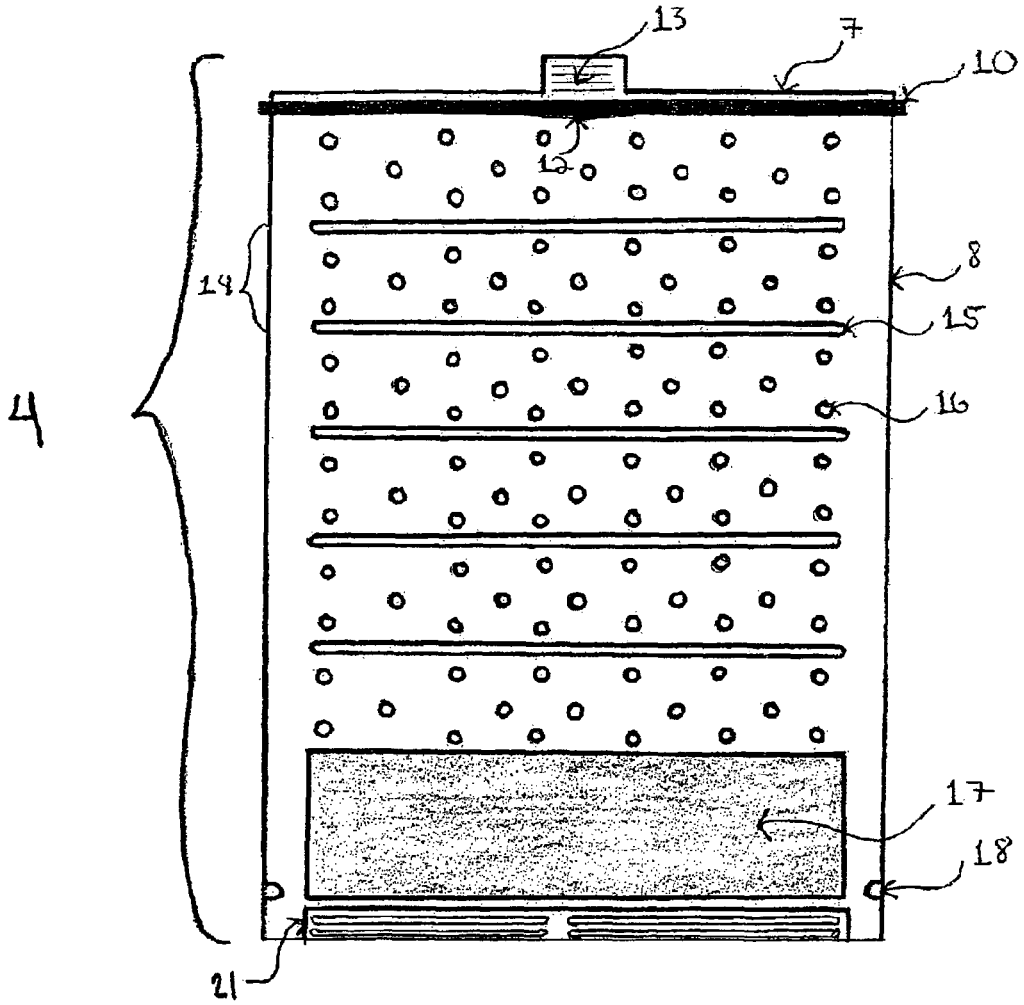
FIG. 3 is a rear view of the accessory for supplying fluids to an applicator roller and brush.
Figure 4:
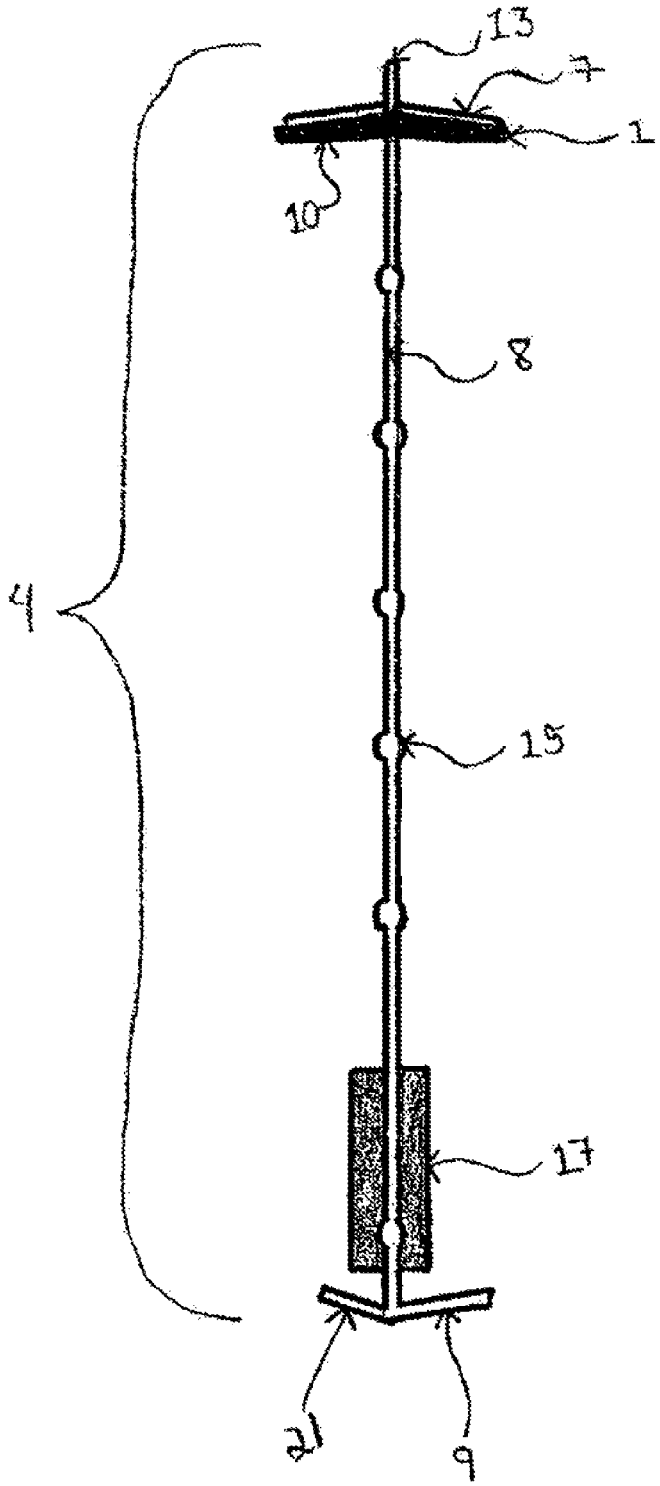
FIG. 4 is a side view of the accessory for supplying fluids to an applicator brush and roller.
Figure 5:
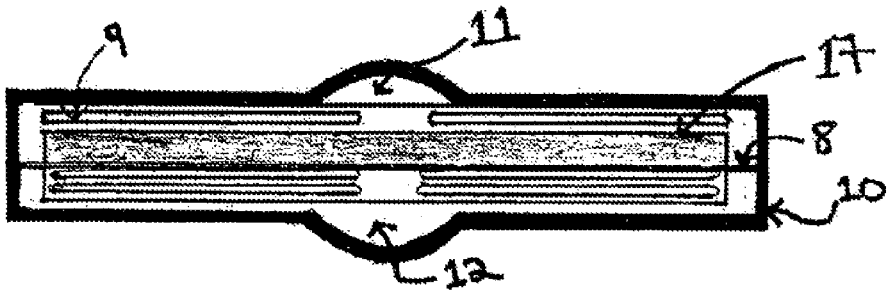
FIG. 5 is a bottom view of the accessory for supplying fluids to an applicator roller and brush.
Figure 6:
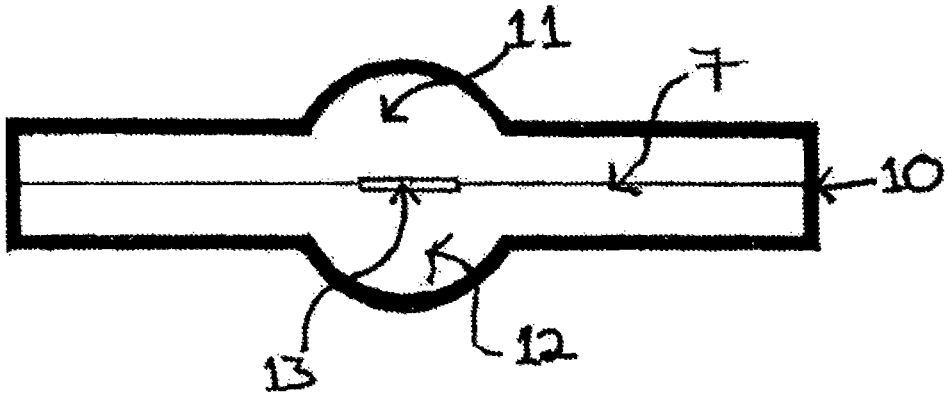
FIG. 6 is a top view of the accessory for supplying fluids to an applicator roller and brush.
Figure 7:
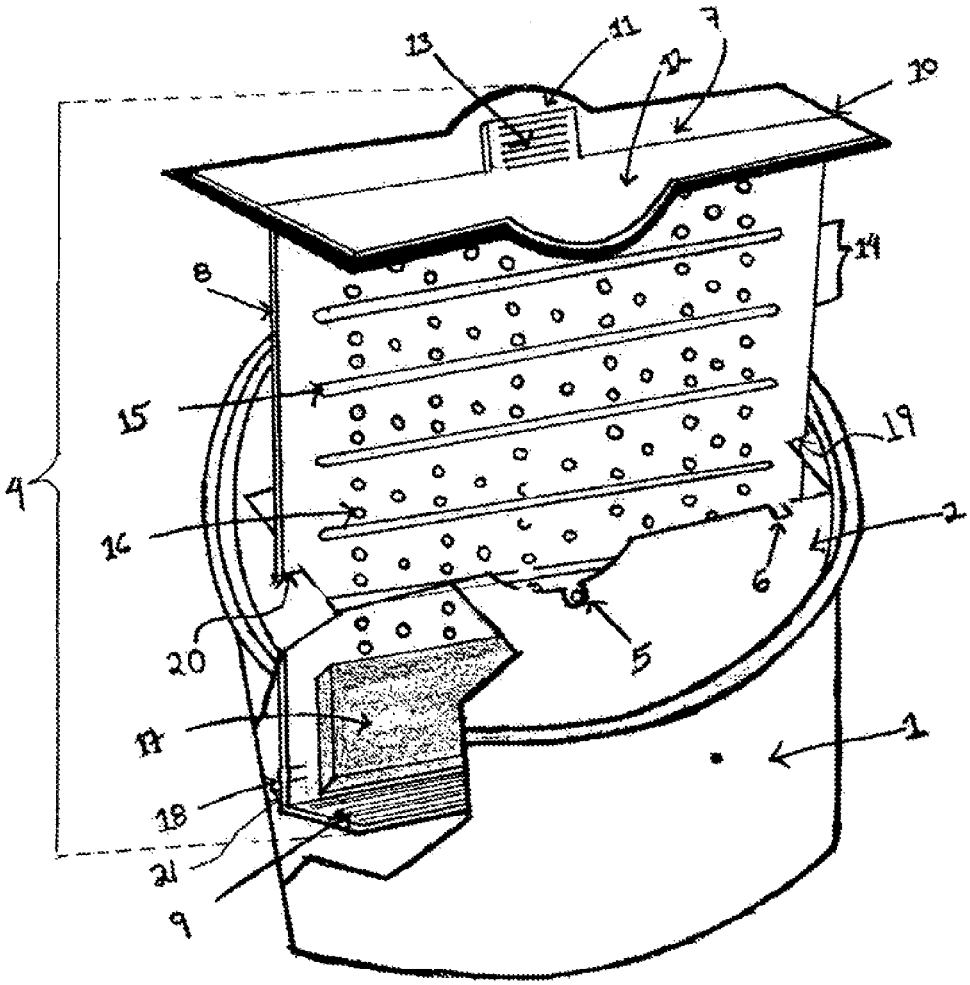
FIG. 7 is a perspective view of the accessory for supplying fluids to an applicator roller and brush in the container cross-section.
Figure 8:
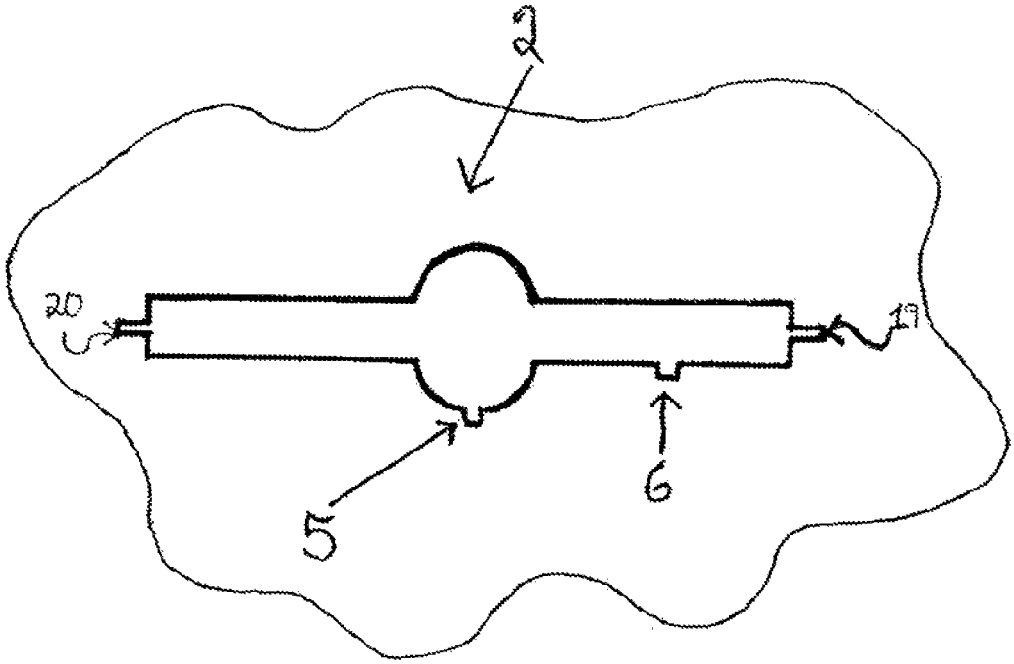
FIG. 8 is a top view of the opening in the container.

With reference to these figures, the accessory for supplying fluids to a brush and roller applicator comprises:

a) a container 1 on top of which is placed a cover 2 having an opening in its central part with dimensions matching the cover 7 of the dispensing device 4 and the periphery has two notches 5 and 6 respectively for stopping the neck of a conventional roller when said roller is not in use and also having in its longitudinal edges other notches 19 and 20 serving to guide said dispensing device into the container, and b) a dispensing device 4 formed by a cover 7, a first perforated panel 8 perpendicular to cover 7 and a second panel with grid 9, the cover 7 is flat and its periphery has a gasket 10 which is adapted to the shape of the cover 7, the shape is rectangular and its central part has two semicircular notches 11 and 12 similar and opposite with respect to the cover 7 center, and the cover 7 has a flat slotted rectangular handle 13 by the upper part, the perforated panel 8 is attached to cover 7 and split into at least one section 14 by at least one longitudinal stop 15, at least two holes 16 are arranged in said section 14 where liquid 1 spreads therethrough when the dispensing device 4 closes said container, an absorbent material 17 (preferably sponge) is present on the bottom part of perforated panel 8 preferably on both sides in order to raise more liquid volume when the dispensing device 4 is no longer coated by the liquid. The bottom part of perforated panel 8 further having at least one stop 18 in an edge of the panel 8 which prevents the dispensing device 4 from being fully removable from the container 1 via the opening in the container cover 7, and finally the perforated panel 8 at the opposite end of the cover 7 has a first panel 9 tilted between 1° and 80° whereby the liquid is stirred into the container 1 via a grid, being shown at front in FIG. 1 a second panel 21 (in FIG. 1 to back) which may also have a grid, the second panel 21 with the same inclination than the first panel 9 but the width of panel 21 being less than the width of the perforated panel 8 (see FIG. 3).

Figure 9:
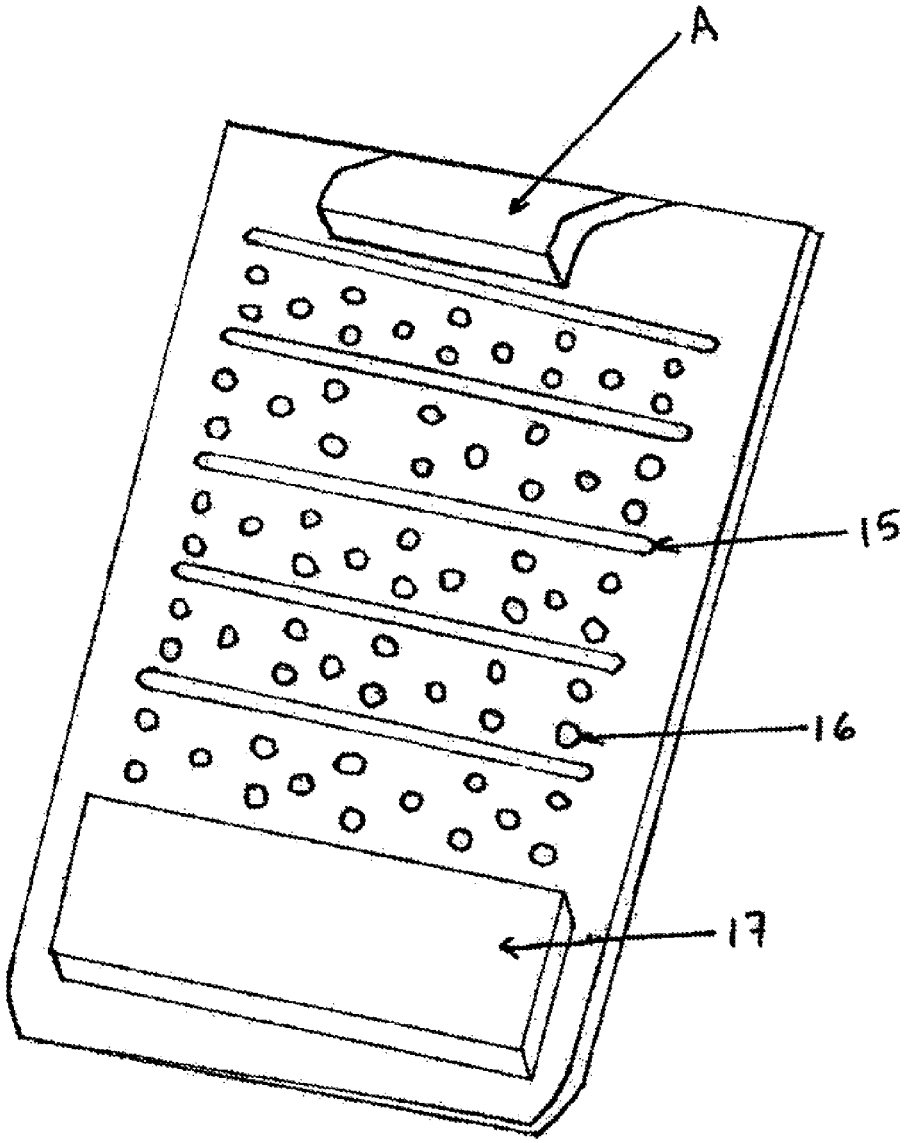
FIG. 9 is a perspective view of the embodiment (hooks) in the dispensing device.
Figure 10:
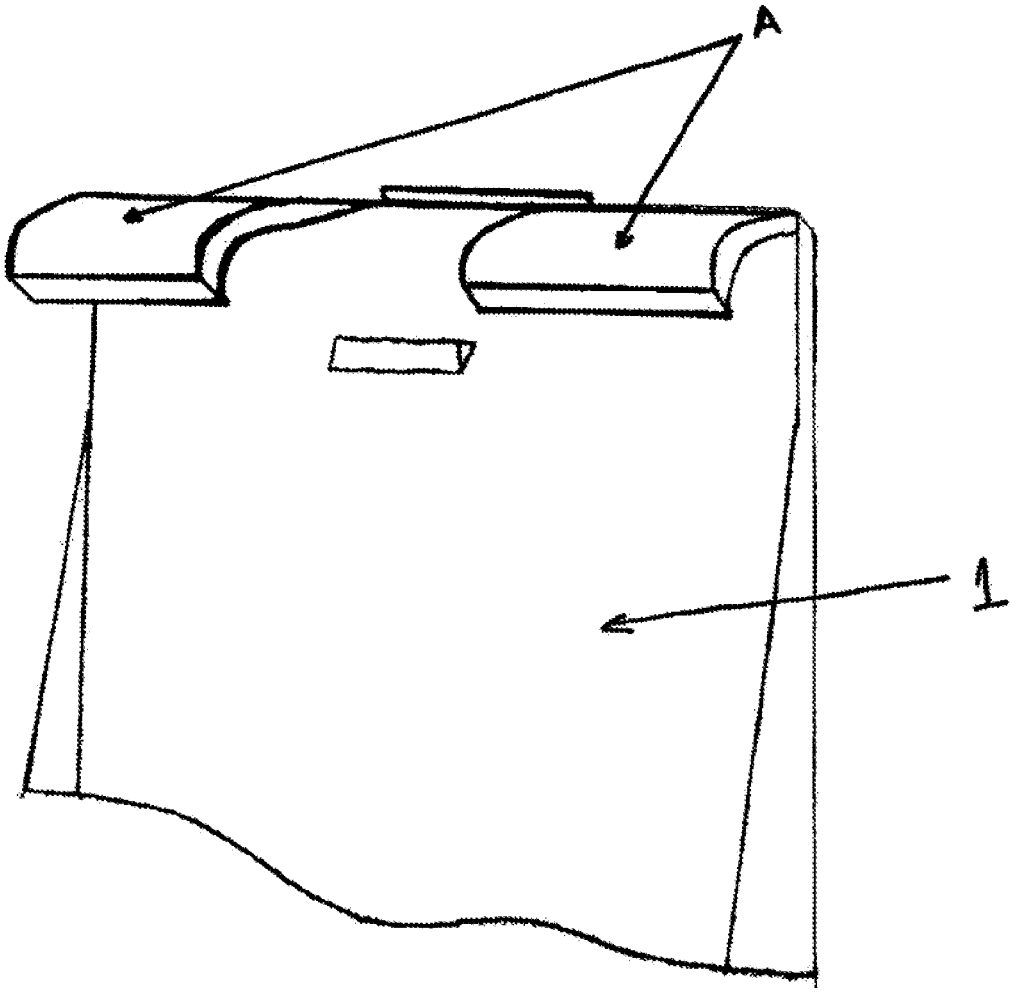
FIG. 10 is a perspective view of the embodiment (hooks) in the container.

A significant alteration in both components of an accessory for supplying fluids to an applicator such as brush and roller, is to use hooks A instead of the cover 7 of the dispensing device 4 (see FIG. 9) and in the container 1 (see FIG. 10) to allow fastening in steps of a ladder at distances that could be raised off the floor and allowing the accessory for supplying fluids to an applicator such as brush and roller to work without having to climb stairs up and down, or when using extensions in a brush or roller for painting at heights used to invert the extension and the device (turn it upside down) in order to take the paint out of the employed container.

In an exemplary embodiment, the present invention is an accessory for supplying fluids to an applicator comprising a container having a container cover with an opening and a dispensing device having a top end and a bottom end, the dispensing device comprising a dispensing device cover with a periphery at the top end, a first panel with a first grid in the bottom end, a second panel with a second grid in the bottom end, and a perforated panel having a first side and a second side, the perforated panel movable through the opening in the container cover and extending between the dispensing device cover and the first and second panels, the perforated panel having an upper part and a lower part, the upper part having at least two through holes and at least one upper part longitudinal stop on at least one of the first and second sides, and the lower part having an absorbent material on at least one of the first and second sides.

The perforated panel can extend perpendicularly from the dispensing device cover.

The first panel can extend a first length from the perforated panel in a plane different than the perforated panel, at a first angle from the first side of the perforated panel. The second panel can extend a second length from the perforated panel in a plane different than the perforated panel, at a second angle from the second side of the perforated panel.

One or both of the first and second panels can prevent the dispensing device from being fully removable from the container via the opening in the container cover.

The lower part of the perforated panel can further comprise at least one lower part longitudinal stop on at least one of the first and second sides, the at least one lower part longitudinal stop preventing the dispensing device from being fully removable from the container via the opening in the container cover.

The first angle and second angle can be the same. The first and second angles can be between 1° and 80° relative the respective side of the perforated panel.

The first length can be different than the second length. The width of the first panel can be the same as the width of the perforated panel, and the width of the second panel can be less than the width of the perforated panel.

The dispensing device can further comprise a gasket located about the periphery of the dispensing device cover. The dispensing device cover can be flat, and the dispensing device cover with gasket can be cooperatively shaped with the opening in the container cover in all aspects save for the at least one notch.

The dispensing device can further comprise a flat slotted rectangular handle.

Instead of (or in conjunction with) the dispensing device cover, the dispensing device can comprise a dispensing device hook at the top end. The container can also comprise a hook.

While the invention has been disclosed in its exemplary forms, it will be apparent to those skilled in the art that many modifications, additions, and deletions can be made therein without departing from the spirit and scope of the invention and its equivalents, as set forth in the following claims.

Having sufficiently described the invention, I consider novel and therefore I claim as my property, the contents of the following claims:

1. An accessory for supplying fluids to an applicator comprising:

a container having a container cover with an opening; and a dispensing device having a top end and a bottom end, the dispensing device comprising:

a dispensing device cover with a periphery at the top end;

a first panel with a first grid in the bottom end;

a second panel with a second grid in the bottom end; and a perforated panel having a first side and a second side, the perforated panel movable through the opening in the container cover and extending between the dispensing device cover and the first and second panels, the perforated panel having an upper part and a lower part, the upper part having at least two through holes and at least one upper part longitudinal stop on at least one of the first and second sides, and the lower part having an absorbent material on at least one of the first and second sides.

2. The accessory of claim 1, wherein the perforated panel extends perpendicularly from the dispensing device cover.

3. The accessory of claim 1, wherein the first panel extends a first length from the perforated panel in a plane different than the perforated panel, at a first angle from the first side of the perforated panel.

4. The accessory of claim 1, wherein the second panel extends a second length from the perforated panel in a plane different than the perforated panel, at a second angle from the second side of the perforated panel.

5. The accessory of claim 1, wherein one or both of the first and second panels prevents the dispensing device from being fully removable from the container via the opening in the container cover.

6. The accessory of claim 1, the lower part of the perforated panel further comprising at least one lower part longitudinal stop on at least one of the first and second sides, the at least one lower part longitudinal stop preventing the dispensing device from being fully removable from the container via the opening in the container cover.

7. The accessory of claim 1, wherein the first angle and second angle are the same.

8. The accessory of claim 1, the first and second angles being between 1° and 80° relative the respective side of the perforated panel.

9. The accessory of claim 1, wherein the first length is different than the second length.

10. The accessory of claim 1, wherein the width of the first panel is the same as the width of the perforated panel, and the width of the second panel is less than the width of the perforated panel.

11. The accessory of claim 1, wherein the dispensing device further comprises a gasket located about the periphery of the dispensing device cover.

12. The accessory of claim 1, wherein the dispensing device further comprises a gasket located about the periphery of the dispensing device cover, wherein the dispensing device cover is flat, and the dispensing device cover with gasket is cooperatively shaped with the opening in the container cover in all aspects save for the at least one notch.

13. The accessory of claim 1, wherein the dispensing device further comprises a flat slotted rectangular handle.

14. An accessory for supplying fluids to an applicator comprising:

a container having a flat container cover with an opening having a central part and at least one notch, the at least one notch located on a periphery of the opening beyond the central part and shaped to stop the neck of an applicator when not in use; and a dispensing device having a top end and a bottom end, the dispensing device comprising:

a dispensing device cover with a periphery at the top end, the dispensing device cover having a central part cooperatively shaped with the central part of the opening of the container cover;

a flat slotted rectangular handle extending upwardly from the dispensing device cover;

a gasket located about the periphery of the dispensing device cover, the dispensing device cover with gasket cooperatively shaped with the opening in the container cover in all aspects save for the at least one notch;

a first panel with a first grid in the bottom end;

a second panel with a second grid in the bottom end; and a perforated panel extending downwardly from the dispensing device cover and having a first side and a second side, the perforated panel movable through the opening in the container cover and extending perpendicularly from the dispensing device cover, the perforated panel having an upper part and a lower part, the upper part having at least two through holes and at least one upper part longitudinal stop on at least one of the first and second sides, and the lower part having at least one lower part longitudinal stop on at least one of the first and second sides and absorbent material on at least one of the first and second sides;

wherein the first panel extends a first length from the perforated panel in a plane different than the perforated panel, at a first angle of between 1° and 80° relative the first side of the perforated panel;

wherein the second panel extends a second length from the perforated panel in a plane different than the perforated panel, at a second angle from the second side of the perforated panel; and wherein the at least one lower part longitudinal stop prevents the dispensing device from being fully removable from the container via the opening in the container cover.

15. The accessory of claim 14, wherein the second angle is the same as the first angle.

16. The accessory of claim 14, wherein the first length is different than the second length.

17. The accessory of claim 14, wherein the width of the first panel is the same as the width of the perforated panel, and the width of the second panel is less than the width of the perforated panel.

18. An accessory for supplying fluids to an applicator comprising:

a container having a container cover with an opening; and a dispensing device having a top end and a bottom end, the dispensing device comprising:

a dispensing device hook at the top end;

a first panel with a first grid in the bottom end;

a second panel with a second grid in the bottom end; and a perforated panel having a first side and a second side, the perforated panel movable through the opening in the container cover and extending from the dispensing device hook, the perforated panel having an upper part and a lower part, the upper part having at least two through holes and at least one upper part longitudinal stop on at least one of the first and second sides, and the lower part having at least one lower part longitudinal stop on at least one of the first and second sides and absorbent material on at least one of the first and second sides;

wherein the first panel extends at a first angle from the perforated panel; and wherein the second panel extends at a second angle from the perforated panel.

19. The accessory of claim 18, wherein the container further comprises a hook.

20. The accessory of claim 18, wherein the container cover is flat.

* * * * *